US005303716A

United States Patent [19]

Mason et al.

[11] Patent Number: 5,303,716

[45] Date of Patent: Apr. 19, 1994

[54] PORTABLE DEVICE FOR REHABILITATIVE EXERCISE OF THE LEG

[75] Inventors: Bradley R. Mason, Olivenhain; Jeffrey T. Mason, Escondido, both of Calif.

[73] Assignee: Breg, Inc., Vista, Calif.

[21] Appl. No.: 974,980

[22] Filed: Nov. 12, 1992

[51] Int. Cl.[5] ..... A61H 1/02

[52] U.S. Cl. ..... 601/34; 602/35; 482/148; 482/904

[58] Field of Search ..... 602/32-35; 128/25 B, 25 C, 25 R, 26, 75; 606/241; 482/52, 70, 114, 120, 907; 5/81.1, 83.1, 624; 294/74

[56] References Cited

U.S. PATENT DOCUMENTS

| | | | |
|---|---|---|---|
| 3,612,047 | 10/1971 | Fry | 128/25 R |
| 4,489,713 | 12/1984 | Latenser | 5/624 |
| 4,492,222 | 1/1985 | Hajianpour | 128/25 R |
| 4,674,485 | 6/1987 | Swanson | 602/33 |
| 4,825,852 | 5/1989 | Genovese et al. | 128/25 R |
| 4,834,073 | 5/1989 | Bledsoe et al. | 128/25 B |
| 4,974,830 | 12/1990 | Genovese et al. | 272/25 R |
| 5,076,576 | 12/1991 | Johnston | 272/121 |

FOREIGN PATENT DOCUMENTS

| | | | |
|---|---|---|---|
| 1540824 | 2/1990 | U.S.S.R. | 128/25 B |

*Primary Examiner*—Richard J. Apley
*Assistant Examiner*—Jeanne M. Mollo
*Attorney, Agent, or Firm*—Rodney F. Brown

[57] ABSTRACT

A portable rehabilitation device employing a suspension system to enable passive or active range of motion exercise of the knee or hip joint. The device has a base adapted to support the suspension system while the patient reclines to perform the respective leg exercises. The suspension system includes a linear track that retains three shuttles slidably positioned in series along the track attached to flexion, extension and leg support lines respectively. A pair of leg cuffs are connected to the leg support line and suspend the leg while isolating the knee joint. For passive suspension exercise, the leg support line is secured and the leg is suspended by only a single cuff at the ankle with the knee joint in a position of full extension. For passive motion exercise, the leg is suspended by both cuffs and the patient alternately pulls on handles attached to the flexion and extension lines causing alternate passive flexion and extension of the knee and hip joint. The same procedure is repeated for assisted active motion exercise, but the patient partially drives the support line with the leg muscles, thereby augmenting the external drive applied by the handles. For independent active motion exercise, the patient releases the handles and drives the leg support line entirely with the leg muscles.

20 Claims, 3 Drawing Sheets

PORTABLE DEVICE FOR REHABILITATIVE EXERCISE OF THE LEG

TECHNICAL FIELD

The present invention relates to a device for rehabilitative exercise of the leg and more particularly to a device enabling passive or active range of motion exercise of the knee or hip joint.

BACKGROUND OF THE INVENTION

Immediate post-operative rehabilitation of the knee or hip joint is desirable following many surgical procedures, including total joint replacement or joint reconstruction, to restore the joint to its full range of motion. Effective rehabilitation requires controlled movement of the knee or hip joint as soon as possible after surgery without bearing weight on the joint or placing a substantial force load on the joint. As rehabilitation progresses, the range of joint movement can be increased and force loads can be applied to the joint.

One type of device that has been developed for rehabilitative leg exercise is termed a continuous passive motion device. Such devices, as for example disclosed in U.S. Pat. No. 4,974,830 to Genovese et al., mount the leg on a rigid support structure while the knee is driven through alternating flexion and extension motion by applying an external force to the knee across a mechanical pivot point. Continuous passive motion devices known in the art, however, require careful anatomical alignment of the rigid support structure with the leg and strict monitoring of the external force loads applied to the leg joints to prevent post-operative injury to the joint during rehabilitation thereof. Furthermore, such devices are relatively complex and cumbersome to operate and maintain, as well as costly to produce.

As such, it is an object of the present invention to provide a device for rehabilitation of a leg joint, and in particular a knee or hip joint, which is portable, relatively inexpensive to produce, and relatively simple to operate and maintain. It is another object of the present invention to provide a device for rehabilitation of the knee or hip joint which is readily adaptable to different size legs without requiring careful anatomical alignment of the device with the knee joint.

It is a further object of the present invention to provide a device that can passively apply a limited external force to the knee or hip joint for range of motion exercise thereof with a minimal risk of injury to the joint. It is another object of the present invention to provide a device that can actively apply a desired degree of the patient's own leg muscle force to the knee or hip joint for range of motion exercise of the joint without bearing weight thereon. It is yet another object of the present invention to provide a device that can be adapted to enable passive suspension of the leg for continuous extension exercise of the knee joint.

SUMMARY OF THE INVENTION

The present invention is a rehabilitation device employing a system to suspend the leg and enable range of motion exercise of a leg joint, and particularly the knee or hip joint, in accordance with the objectives set forth above. The suspension system is flexibly configured to permit three dynamic modes of knee exercise, i.e., passive motion, assisted active motion, and independent active motion. The system also permits one static mode of exercise, i.e., passive suspension.

The device comprises a portable base adapted to freely stand on a support surface on which the patient reclines to perform the respective leg exercises. The base maintains the suspension system in an elevated position above the support surface. The suspension system includes a linear track that retains three shuttles slidably positioned in series along the longitudinal axis of the track. One shuttle is a flexion shuttle positioned nearest the proximal end of the track (relative to the patient). Another shuttle is an extension shuttle positioned nearest the distal end of the track and the final shuttle is a leg support shuttle positioned between the flexion and extension shuttles.

A flexion line, a leg support line and an extension line are securedly affixed to the flexion shuttle, leg support shuttle and extension shuttle, respectively. Segments of the flexion, leg support and extension lines are coaxially aligned with the longitudinal axis of the track by a plurality of line redirection members proximally and distally positioned on the track. The line redirection members further serve as stops to prevent the shuttles from disengaging the track at the ends thereof.

The proximal segment of the leg support line is releasably secured by a height locking member to the proximal end of the track, while the distal segment of the leg support line is slidably suspended from the distal end of the track at a right angle thereto across a distal redirection member. An intermediate segment of the leg support line is slidably suspended from the track across a pair of redirection members positioned in series along the track.

An upper leg cuff is slidably attached to the intermediate segment of the leg support line across a redirection member freely positioned along the intermediate segment. A lower leg cuff is also attached to the distal segment of the leg support line. The lower leg cuff is adapted to engage the ankle of the patient and the upper leg cuff is adapted to engage the thigh of the patient, thereby enabling balanced suspension of the leg from the cuffs to maintain the knee joint in isolation between the cuffs. The cuffs are flexibly suspended from the portable track and base assembly, and are interactively connected to one another across the patient's actual knee joint rather than across a rigid mechanical joint as in prior art structures. Accordingly, the flexibly-suspended cuffs intrinsically align with the anatomical structure of the leg without requiring strict adjustment of cuff alignment.

The extension line runs proximally, coaxial with the longitudinal axis of the track, from the extension shuttle to which it is secured toward the proximal end of the track where it engages a proximal redirection member. In contrast, the flexion line runs distally, coaxial with the longitudinal axis of the track, from the flexion shuttle to which it is secured toward the distal end of the track, where it engages a distal redirection member. The distal redirection member reverses the direction of the flexion line, doubling it back toward the proximal end of the track where the line engages a proximal redirection member. The flexion and extension lines both have segments proximally extending from their respective proximal redirection members which have handles attached thereto for passive or assisted active operation of the device by the patient.

To operate the device, the leg height of the system is initially set by releasing the height locking member and sliding the leg support line therethrough to a desired position. The leg support line is secured to the track at the desired leg height by reengaging the height locking member. The leg is then suspended from the device by engaging the ankle with the lower leg cuff and engaging the thigh with the upper leg cuff while the patient is in a reclining position.

For the passive suspension mode of exercise, an extension locking member positioned on the track proximal to the flexion shuttle is engaged to secure the line to the track at this point. The upper leg cuff is then disengaged from the thigh while the lower leg cuff is maintained in engagement with the ankle. Consequently, the thigh hangs freely and the leg is suspended by the ankle with the knee joint in a position of full extension. This position is passively maintained as long as desired.

For the passive motion mode of exercise, the leg is retained in both cuffs with the extension locking member unsecured. The patient grasps each handle with a hand and alternately pulls on each handle causing the flexion and extension shuttles to displace the leg support shuttle back and forth. The leg support line moves in correspondence with the displacement of the leg support shuttle causing alternate passive flexion and extension of the knee and hip joints through the desired range of motion. The same procedure is repeated for the assisted active motion mode of exercise, but the patient partially drives the support line with the leg muscles, thereby augmenting the manual drive applied by the handles to exercise the knee or hip joint through the desired range of motion. For the independent active motion mode of exercise, the patient releases the handles and drives the leg support line entirely with the leg muscles.

The invention will be further understood, both as to its structure and operation, from the accompanying drawings, taken in conjunction with the accompanying description, in which similar reference characters refer to similar parts.

DESCRIPTION OF PREFERRED EMBODIMENTS

Figure 1:
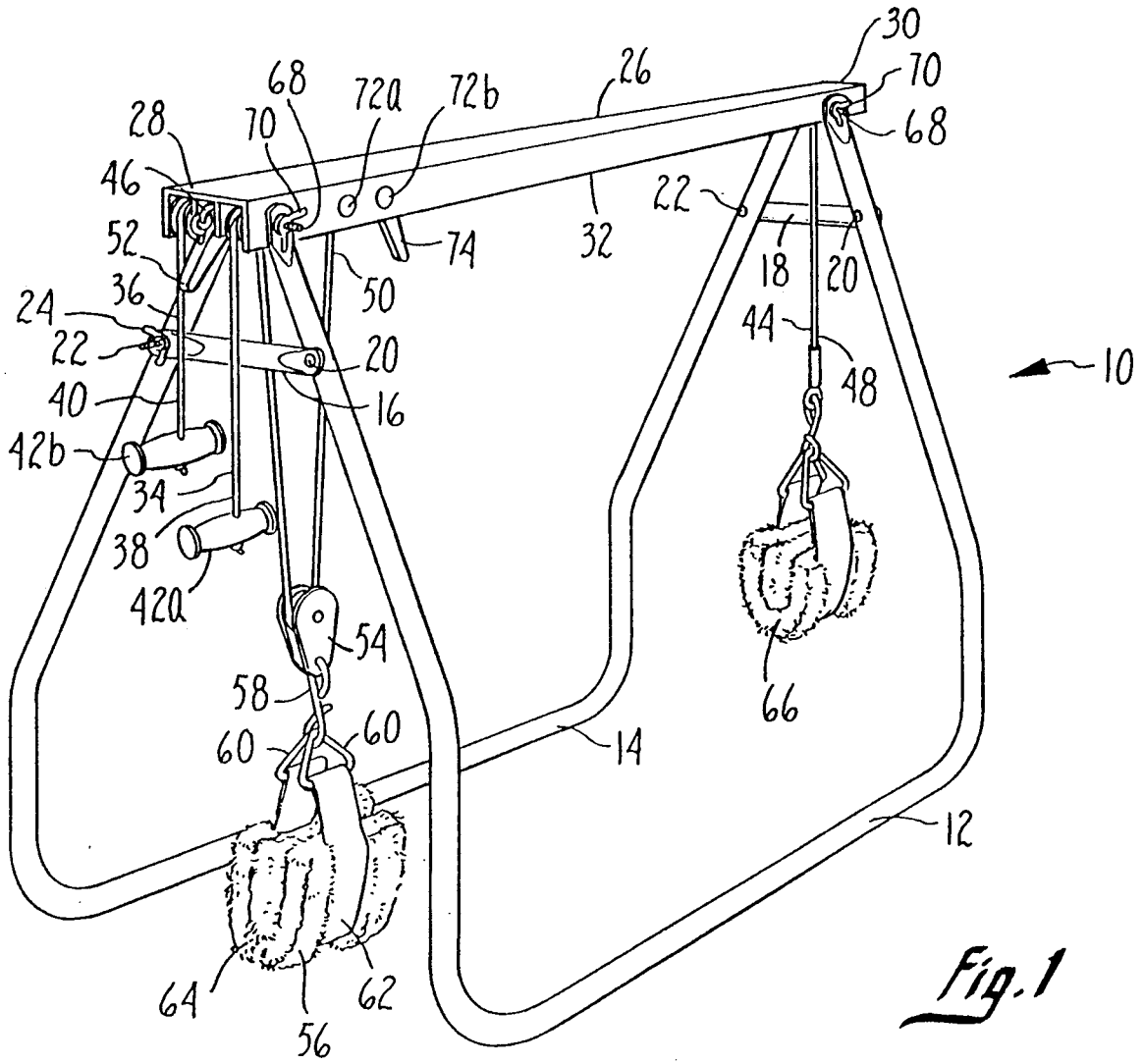
FIG. 1 is a perspective view of the rehabilitation device of the present invention.

Referring initially to FIG. 1, the rehabilitation device of the present invention is shown and generally designated as 10. The device 10 has a lightweight collapsible base that renders it fully portable and compact for storage. The base comprises a pair of tubular metal legs 12, 14 that are stabilized by a pair of rigid metal crossbars 16, 18. The crossbars 16 and 18 are rotatably secured to one leg 12 by a rivet 20 extending through crossbars 16 and 18 and leg 12. The crossbars 16 and 18 are removably secured to the other leg 14 by a removable threaded bolt 22 that extends through crossbars 16 and 18 and leg 12 and has a wing nut 24 affixed thereto.

The base maintains the leg suspension system of the present device 10 in a substantially parallel position above a surface on which a patient reclines to perform the rehabilitative exercises enabled by the device 10. The suspension system is supported by a rigid metal track 26. The track 26 is an elongated shell with a hollow rectangular cross-section that is partially open at its proximal and distal ends 28, 30 and along its bottom face 32 to enable certain components of the extension system to extend therefrom. Among the components of the suspension system extending from the track 26 are flexion and extension lines 34, 36 formed from flexible nylon cord or other conventional rope material.

Both lines 34, 36 have interior segments (not shown in FIG. 1) coaxially retained within the track 26 and have proximal segments 38, 40 extending from the proximal end 28 of the track 26 with handles **42*a*, 42*b* knotted thereto. The suspension system is further provided with a flexible leg support line 44 having proximal, distal and intermediate segments 46, 48, 50 extending therefrom. The leg support line 44 also has an interior segment (not shown in FIG. 1) coaxially retained within the track 26. The proximal segment 46 is knotted to prevent it from sliding distally past a height locking member 52 provided at the proximal end 28 of the track 26**.

A redirection member 54, shown here as a pulley, is slidably positioned along the intermediate segment 50 of the leg support line 44. An upper leg cuff 56 formed in the configuration of a sling from a flexible textile material is removably connected to the redirection member 54 by means of a rigid metal figure eight loop 58 and a pair of rigid metal cuff loops 60. The cuff loops 60 are secured to a nylon reinforcement strap 62 centrally positioned on the cuff 56. A fleece cuff liner 64 is also provided to conform to and cushion the portion of the patient's leg that the cuff 56 engages as described hereafter. A lower leg cuff 66 having substantially the same configuration as the upper leg cuff 56 is removably connected to the distal segment 48 of the leg support line 44 in substantially the same manner as cuff 56 is attached to the intermediate segment 50.

The legs 12, 14 of the base are connected to the track 26 by a pair of threaded bolts 68 that extend proximally and distally through legs 12 and 14 and have wing nuts 70 affixed thereto. The bolts 68 further secure the height locking member 52, as well as proximal and distal redirection members (not shown in FIG. 1, but described hereafter with reference to FIG. 2), to the track 26. Rivets **72*a*, 72*b* also extend through the track 26 to secure an intermediate redirection member (also not shown in FIG. 1) and an extension locking member 74 to the track 26**, respectively.

Figure 2:
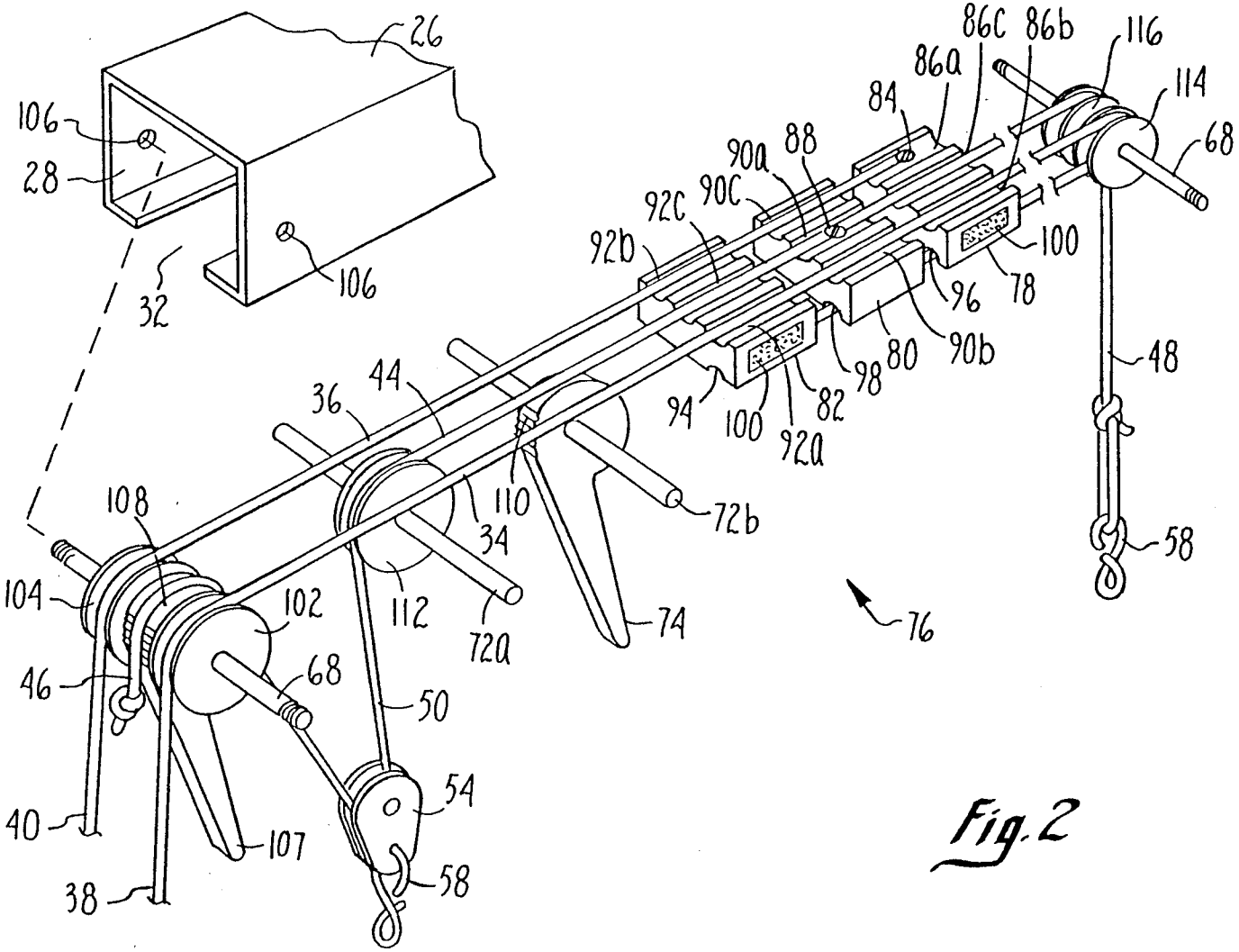
FIG. 2 is a perspective view of the rehabilitation device as shown in FIG. 1, having the track removed to expose the interior thereof.

Details of the suspension system, including those components residing interior to the track 26, are described hereafter with reference to FIG. 2, wherein the track 26 has been lifted away from the suspension system for clarity. The suspension system is generally designated 76 in FIG. 2 and comprises three shuttles 78, 80, 82 that are retained in series within the track 26 to slide along the longitudinal axis thereof.

The shuttles 78, 80, 82 are formed from a material slidably compatible with the material of the track 26, such as a rigid plastic. The most distal shuttle, extension shuttle 78, is fixedly fastened to the extension line 36 by means of a fastening screw 84 driven through the line 36 into the shuttle 78. A groove 86*a* is formed in the top of the shuttle 78 to receive the extension line 36. Grooves 86*b*, 86*c* are also formed in the top of the shuttle 78 to slidably receive the flexion and leg support lines 34 and 44, respectively.

The intermediate shuttle, leg support shuttle 80, is fixedly fastened to the leg support line 44 by means of a fastening screw 88 driven through the line 44 into the shuttle 80. A groove 90*a* is formed in the top of the shuttle 80 to receive the leg support line 44. Grooves 90*b*, 90*c* are also formed in the top of the shuttle 80 to slidably receive the flexion and extension lines 34 and 36, respectively.

The most proximal shuttle, flexion shuttle 82, is fixedly fastened to the flexion line 34 by means of a fastening screw (not shown) affixed to the bottom of shuttle 82 in substantially the same manner as fastening screws 84 and 88, with the fastening screw being driven through the line 34 into the shuttle 82. Grooves 92*a*, 92*b*, 92*c* are formed in the top of the shuttle 82 to slidably receive the flexion line 34, extension line 36 and leg support line 44, respectively. A groove 94 is also formed in the bottom of the shuttle 82 to receive the flexion line 34 where it is fastened to the shuttle 82. Grooves 96, 98 are likewise formed in the bottom of shuttles 78 and 80, respectively, to slidably receive the flexion line 34.

The outer sides of the extension and flexion shuttles 78, 80 have friction pads 100 affixed thereto. The pads 100 are formed from a coarse long-napped textile material that slidably engages the inner sides of the track 26 to increase the force required to slide the shuttles 78, 80 and prevent inadvertent slippage thereof.

A plurality of proximal redirection members 102, 104, 52 are provided at the proximal end of the track 26 to engage the flexion, extension and leg support lines 34, 36, 44, respectively. Each redirection member by definition provides a surface, across which the direction a respective line extends is altered. The proximal redirection members 102, 104, 52 are maintained in adjacent rotatable position by the bolt 68 extending therethrough and further extending through holes 106 in the track 26. Proximal redirection members 102 and 104 are shown in FIG. 2 to be sheaves, preferably formed from a rigid plastic. Encompassed within the present embodiment, however, the redirection members 102, 104 can be substantially any surface, although preferably a grooved arcuate surface, that is either rotatably or fixedly attached to the track 26 across which the lines can be redirected.

It is noted in the present embodiment that member 52, formed from a rigid metal, serves as both the height locking member and the proximal redirection member in engagement with the leg support line 44. However, it is understood that a separate proximal redirection member substantially similar to members 102 and 104 could be provided distally adjacent to locking member 52, thereby obviating the redirection function of member 52. For the locking function, member 52 is configured with a handle 107 and a head 108 having ridges 110 formed thereon (shown on member 74) to grip line 44 when engaged against the track 26 in a ratchet-like manner. The extension locking member 74, distally positioned between an intermediate redirection member 112 and the flexion shuttle 82, is configured in a substantially identical manner to the height locking member 52, but does not serve a redirection function.

The intermediate redirection member 112 is provided to engage the leg support line 44 at an intermediate point along the track 26. Distal redirection members 114, 116 are further provided at the distal end 30 of the track 26 to engage the flexion and leg support lines 34, 44, respectively. The distal redirection members 114, 116 are maintained in adjacent rotatable position by the bolt 68 extending therethrough and further extending through holes provided in the track 26 in a manner of connection similar to members 102, 104. The redirection members 112, 114, 116 are likewise configured substantially similar to the proximal redirection members 102, 104.

Method of Operation

Operation of the rehabilitative leg exercise device 10 is described hereafter with reference to FIGS. 1, 2, and 3A–C. Initially, the leg height is set by rotating the handle 107 counterclockwise to release the height locking member 52. The proximal segment 46 of the leg support line 44 is slid past the height locking member 52 in either direction until the segment of line 44 distal to the locking member 52 has a desired length. The leg support-line 44 is then secured to the track by rotating the handle 107 clockwise to reengage the height locking member 52.

The leg 118 of the patient is suspended from the device 10 while the patient is in a reclining position on a support surface 120 by wrapping the upper leg cuff 56 around the thigh 122 and hooking loops 60 through the loop 58 at the intermediate segment 50 of the leg support line 44. The lower leg cuff 66 is similarly wrapped around the ankle 124 of the patient and attached to the distal segment 48 of the leg support line 44. For practical ease, it is preferable to initially connect the lower leg cuff 66 to the line 44 followed by connection of the upper leg cuff 56.

Figure 3A:
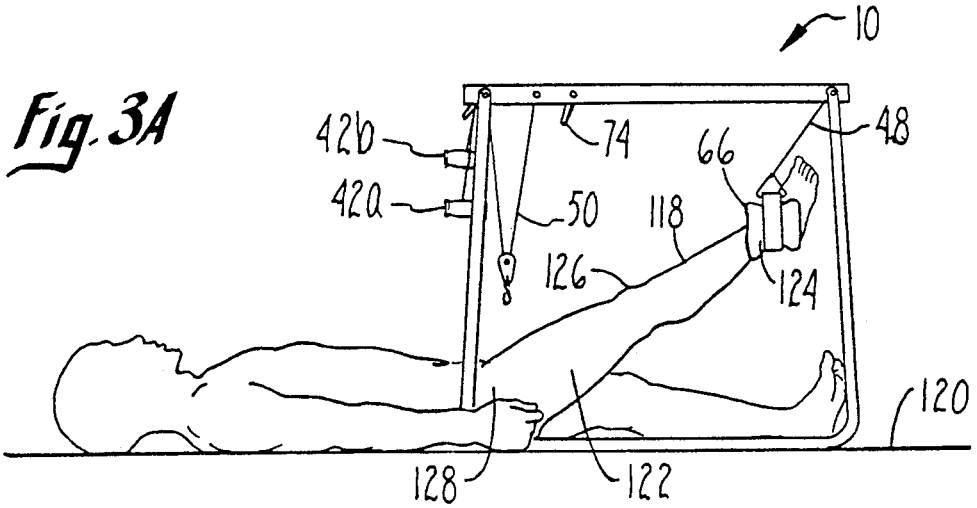
FIG. 3A is an elevational view of the rehabilitation device as shown in FIG. 1 with a patient positioned therein for a passive suspension mode of exercise.

The passive suspension mode of exercise as shown in FIG. 3A is initiated by raising the distal segment of line 44 and engaging the extension locking member 74 in a manner similar to operation of the height locking member 52, thereby securing the leg support line 44 to the track 26 at the location of member 74. The cuff loops 60 on the upper leg cuff 56 are then unhooked from the loop 58 permitting the thigh 122 to hang freely while the leg 118 is suspended by the ankle 124 with the knee joint 126 in a position of full extension.

Figure 3B:
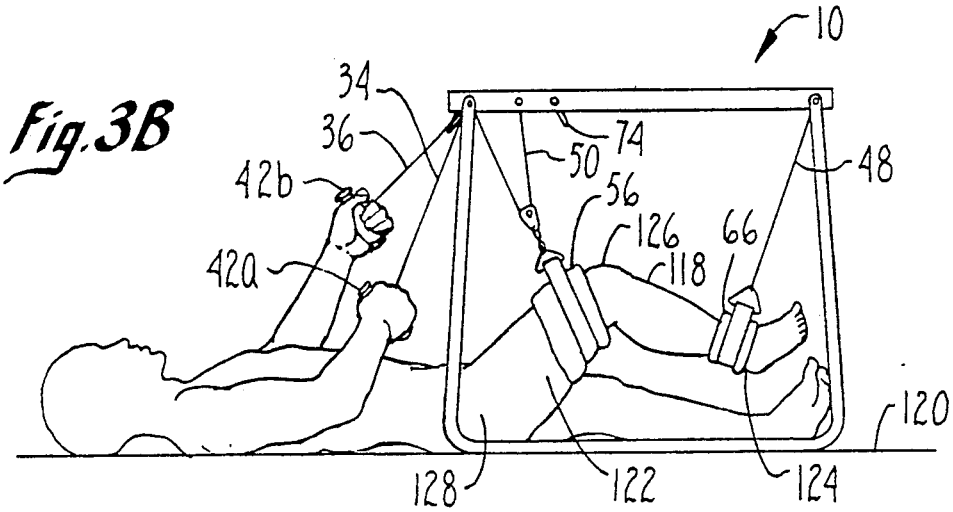
FIG. 3B is an elevational view of the rehabilitation device as shown in FIG. 1 with a patient positioned therein for a passive motion mode or assisted active motion mode of exercise.

The passive motion and assisted active motion modes of exercise as shown in FIG. 3B are initiated by retaining the thigh 122 and ankle 124 within cuffs 56, 66, respectively, with the extension locking member 74 unsecured. The patient grasps the handles 42*a*, 42*b* in each hand and alternately pulls on them. Pulling on the flexion handle 42*a* draws the flexion shuttle 82 distally against the leg support shuttle 80, thereby distally displacing the leg support shuttle 80. The distal segment 48 of the leg support line 44 correspondingly drops, causing passive flexion of the knee joint 126 and hip joint 128. Conversely, pulling on the extension handle 42*b* draws the extension shuttle 78 proximally against the leg support shuttle 80, thereby proximally displacing the leg support shuttle 80. The distal segment 48 of the leg support line 44 correspondingly raises, causing passive extension of the knee joint 126 and hip joint 128. The same procedure is repeated for the assisted active motion mode of exercise, but the patient partially drives the leg support line 44 with the leg muscles, thereby augmenting the manual drive applied across the handles 42*a*, 42*b*.

Figure 3C:
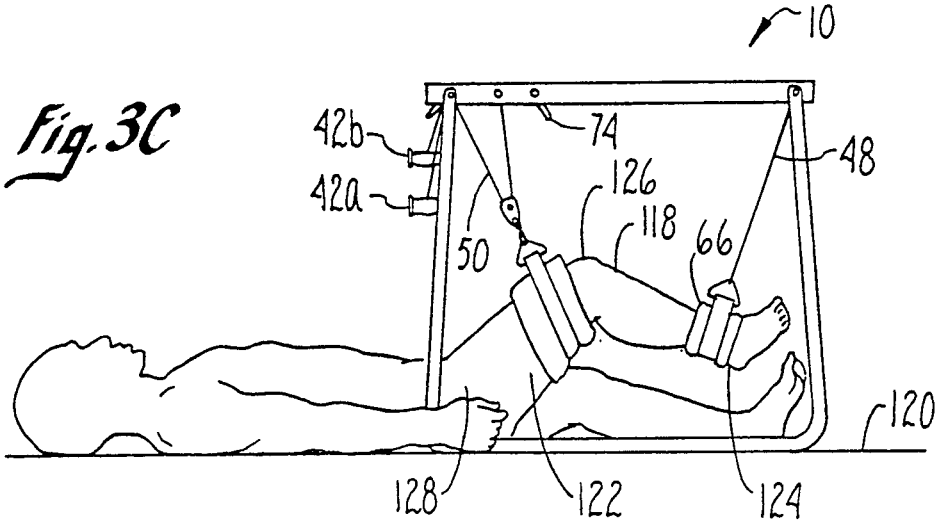
FIG. 3C is an elevational view of the rehabilitation device as shown in FIG. 1 with a patient positioned therein for an independent active motion mode of exercise.

The independent active motion mode of exercise shown in FIG. 3C is substantially the same as the passive motion and assisted active motion modes shown in FIG. 3B, except that in the independent active mode the patient releases the grasp of handles 42*a*, 42*b* and drives the leg support line 44 entirely with the leg muscles. When shuttles 78 and 82 are displaced into distal and proximal positions, respectively, by the alternate motion of shuttle 80, the handles 42*a* and 42*b* retract toward the proximal end 28 of the track 26 where they are maintained stationary during the remainder of the present exercise mode by the function of friction pads 100.

While the forgoing preferred embodiments of the invention have been described and shown, it is understood that alternatives and modifications, such as those suggested and others, may be made thereto and fall within the scope of the invention.

We claim:

1. A portable device for suspending an upper and lower leg of a patient and exercising a knee or hip joint of the leg while the patient is positioned on a support surface, the portable device comprising:

means for holding the upper leg;

means for holding the lower leg;

a flexible leg support line connected to said upper leg holding means along a first segment of said leg support line and connected to said lower leg holding means along a second segment of said leg support line, wherein said first segment is proximally positioned relative to said second segment;

first redirecting means engaging said leg support line between said first and second segments for redirecting said leg support line across said first redirecting means;

second redirecting means engaging said leg support line between said first and second segments for redirecting said leg support line across said second redirecting means; and portable means adapted for positioning on the support surface and for free-standingly supporting said leg support line.

2. A portable device as recited in claim 1 wherein said portable supporting means comprises a plurality of rigid legs attached to an overhead track having said first and second redirecting means affixed thereto, further wherein said plurality of legs form a base shorter in length than the length of the patient.

3. A portable device as recited in claim 2 wherein said second redirecting means is distally positioned on said track relative to said first redirecting means.

4. A portable device as recited in claim 1 wherein said upper leg holding means is slidably connected to said leg support line.

5. A portable device as recited in claim 2 further comprising third means engaging said leg support line for redirecting said leg support line across said third redirecting means, wherein said third redirecting means is proximally affixed to said track relative to said second redirecting means.

6. A portable device as recited in claim 1 further comprising means for manually driving said leg support line across said first and second redirecting means.

7. A device for rehabilitating a leg joint of a patient positioned on a support surface comprising:

a track having a proximal end, a distal end and a longitudinal axis extending therebetween;

a leg support line;

a support shuttle slidably retained along the longitudinal axis of said track and fixedly secured to said support line at a first point thereon;

a distal support line redirection member positioned at said distal end of said track slidably engaging said support line at a second point thereon;

means for securing said support line at a third point thereon to said proximal end of said track;

an intermediate redirection member intermediately positioned on the longitudinal axis of said track proximal to said support shuttle and slidably engaging said support line at a fourth point thereon; and an upper leg cuff connected to said support line at a fifth point thereon between said third and fourth points.

8. A rehabilitation device as recited in claim 7 wherein said securing means is releasable for adjusting the positions of said second, third and fourth points on said support line.

9. A rehabilitation device as recited in claim 7 further comprising a pulley slidably connecting said fifth point of said support line to said upper leg cuff.

10. A rehabilitation device as recited in claim 7 further comprising a lower leg cuff attached to said support line at a sixth point thereon distal to said second point.

11. A rehabilitation device as recited in claim 7 wherein said first and second points on said support line define a segment therebetween aligned substantially parallel to said longitudinal axis of said track.

12. A rehabilitation device as recited in claim 7 further comprising a portable base connected to said track for maintaining said track in an elevated position above the support surface.

13. A device for rehabilitating a leg joint of a patient positioned on a support surface comprising:

a track having a proximal end, a distal end and a longitudinal axis extending therebetween;

a leg support line;

a support shuttle slidably retained along the longitudinal axis of said track and fixedly secured to said support line at a first point thereon;

a distal support line redirection member positioned at said distal end of said track slidably engaging said support line at a second point thereon; and means for securing said support line at a third point thereon to said proximal end of said track;

a proximal support line redirection member distally positioned on the longitudinal axis of said track near said proximal end thereof and slidably engaging said support line at a fourth point thereon;

an upper leg cuff connected to said support line at a fifth point thereon between said third and fourth points;

a flexion shuttle slidably retained along the longitudinal axis of said track between said proximal end of said track and said support shuttle;

an extension shuttle slidably retained along the longitudinal axis of said track between said distal end of said track and said support shuttle;

means for driving said flexion shuttle in a distal direction along said track to displace said support shuttle in said distal direction, thereby flexing the leg joint; and means for driving said extension shuttle in a proximal direction along said track to displace said support shuttle in said proximal direction, thereby extending the leg joint.

14. A rehabilitation device as recited in claim 13 wherein said securing means is releasable for adjusting the positions of said second, third and fourth points on said support line.

15. A rehabilitation device as recited in claim 13 wherein said means for driving said flexion shuttle comprises a knee flexion line fixedly secured to said flexion shuttle at a first point on said flexion line.

16. A rehabilitation device as recited in claim 13 wherein said means for driving said extension shuttle comprises a knee extension line fixedly secured to said extension shuttle at a first point on said extension line.

17. A rehabilitation device as recited in claim 15 wherein said means for driving said extension shuttle comprises a knee extension line fixedly secured to said extension shuttle at a first point on said extension line.

18. A rehabilitation device as recited in claim 17 further comprising an extension line redirection member positioned at said proximal end of said track and slidably engaging said extension line at a second point thereon.

19. A rehabilitation device as recited in claim 18 further comprising a first flexion line redirection member positioned at said distal end of said track and slidably engaging said flexion line at a second point thereon and a second flexion line redirection member positioned at said proximal end of said track and slidably engaging said flexion line at a third point thereon.

20. A rehabilitation device as recited in claim 13 further comprising a portable base connected to said track for maintaining said track in an elevated position above the support surface.

* * * * *